US011761218B2

(12) United States Patent
Steck et al.

(10) Patent No.: US 11,761,218 B2
(45) Date of Patent: Sep. 19, 2023

(54) FASTENING ELEMENT

(71) Applicant: Peri SE, Weissenhorn (DE)

(72) Inventors: Tobias Steck, Weissenhorn (DE); Rene Probstle, Koetz (DE); Philip Endriss, Voehringen (DE); Juergen Andree, Neu-Ulm (DE)

(73) Assignee: PERI SE, Weissenhorn (DE)

( * ) Notice: Subject to any disclaimer, the term of this patent is extended or adjusted under 35 U.S.C. 154(b) by 336 days.

(21) Appl. No.: 16/321,453

(22) PCT Filed: Jul. 26, 2017

(86) PCT No.: PCT/EP2017/068867
§ 371 (c)(1),
(2) Date: Jan. 28, 2019

(87) PCT Pub. No.: WO2018/019877
PCT Pub. Date: Feb. 1, 2018

(65) Prior Publication Data

US 2021/0285242 A1 Sep. 16, 2021

(30) Foreign Application Priority Data

Jul. 27, 2016 (DE) ..... 10 2016 213 773.5

(51) Int. Cl.
*E04G 7/34* (2006.01)
*E04G 1/15* (2006.01)
(Continued)

(52) U.S. Cl.
CPC ..... *E04G 7/34* (2013.01); *E04G 1/152* (2013.01); *E04G 5/147* (2013.01); *E04G 7/305* (2013.01)

(58) Field of Classification Search
CPC ..... E04G 7/34; E04G 7/305; E04G 7/304; E04G 7/306; E04G 1/152; E04G 5/147; E04G 5/16; E04G 2005/148
See application file for complete search history.

(56) References Cited

U.S. PATENT DOCUMENTS 561,263 A * 6/1896 Lucas ..... E04G 1/152 182/119
2,681,834 A * 6/1954 Benson ..... E04G 7/308 52/645

(Continued)

FOREIGN PATENT DOCUMENTS

DE 1559069 9/1969
DE 7411957 7/1974

(Continued)

*Primary Examiner* — Daniel P Cahn
*Assistant Examiner* — Shiref M Mekhaeil
(74) *Attorney, Agent, or Firm* — SLEMAN & LUND LLP

(57) ABSTRACT

A scaffolding element having a scaffolding pole, at least one fastening element being disposed or formed on the scaffolding pole. The fastening element preferably has a fastening element body. The fastening element body can be L-shaped. Preferably, the free end of the fastening element body points straight upwards when the scaffolding element is in the mounted state. A projection is disposed or formed below the free end on the fastening element body, in particular in a section parallel to the longitudinal axis of the scaffolding pole. The projection can be part of a U-shaped bead.

12 Claims, 4 Drawing Sheets

(51) Int. Cl.
*E04G 5/14* (2006.01)
*E04G 7/30* (2006.01)

(56) References Cited

U.S. PATENT DOCUMENTS

| | | | | | |
|---|---|---|---|---|---|
| 2,726,902 | A * | 12/1955 | Borgman | E04G 7/305 | 403/49 |
| 2,808,298 | A * | 10/1957 | Meng | E04G 7/305 | 403/49 |
| 2,841,452 | A * | 7/1958 | Borgman | E04G 7/305 | 403/376 |
| 2,891,820 | A * | 6/1959 | Schoeneberg | E04G 7/305 | 403/376 |
| RE25,053 | E * | 10/1961 | Juculano | E04G 7/304 | 403/49 |
| 3,323,271 | A | 6/1967 | Collins | | |
| 3,458,222 | A * | 7/1969 | Juculano | E04G 7/305 | 403/49 |
| 3,676,972 | A * | 7/1972 | Ballou | E04G 7/301 | 52/645 |
| 3,867,043 | A * | 2/1975 | Plough | E04G 7/304 | 182/186.8 |
| 4,493,394 | A * | 1/1985 | Karlsen | E04G 7/308 | 403/49 |
| 5,112,155 | A * | 5/1992 | Jackson | E04G 7/305 | 403/49 |
| 5,125,477 | A * | 6/1992 | Jordan, III | E04G 5/14 | 182/178.1 |
| 5,145,030 | A * | 9/1992 | Pavlescak | E04G 5/14 | 182/113 |
| 5,154,256 | A * | 10/1992 | Wood | E04G 7/308 | 256/65.13 |
| 5,386,961 | A * | 2/1995 | Lu | B62J 11/00 | 248/912 |
| 6,006,862 | A * | 12/1999 | Palmer | E04G 5/14 | 182/113 |
| 6,422,345 | B1 * | 7/2002 | Schworer | E04G 5/14 | 182/178.5 |
| 10,624,442 | B2 * | 4/2020 | Evans | A45F 5/021 | |
| 2008/0283336 | A1 * | 11/2008 | Clear | E04G 5/06 | 182/224 |

FOREIGN PATENT DOCUMENTS

| | | |
|---|---|---|
| DE | 8711664 | 12/1987 |
| DE | 19633092 | 2/1998 |
| DE | 102004055394 | 7/2005 |
| DE | 102004005636 | 8/2005 |
| DE | 202008001019 | 4/2008 |
| EP | 0234657 | 9/1987 |
| EP | 1262611 | 12/2002 |
| EP | 1589162 | 10/2005 |
| EP | 2085537 | 8/2009 |
| GB | 901351 | 7/1962 |
| GB | 1242224 | 8/1971 |
| JP | 2004076468 | 3/2004 |
| JP | 2006226001 | 8/2006 |
| JP | 2008163740 | 7/2008 |
| PT | 918912 E | 10/2000 |
| WO | 2016083215 | 6/2016 |

* cited by examiner

FASTENING ELEMENT

FIELD OF THE INVENTION

The invention relates to a scaffolding element with a scaffolding pole and longitudinally extending fastening element for attaching a railing to the scaffolding pole, wherein the fastening element is rigidly connected to the scaffolding pole and the fastening element has a fastening element body. The invention further relates to a scaffold with such a scaffolding element as well as a method for mounting or dismantling, in particular in advance, a railing to or from a scaffolding pole.

BACKGROUND OF THE INVENTION

It is known to arrange a railing on a scaffolding pole to protect workers on the scaffold from falling.

From WO 2016/083215 A1 a scaffold with a railing has become known, wherein a scaffolding pole of the scaffold has a mushroom-shaped pin which extends perpendicularly away from the scaffolding pole. A Y-shaped gate with an essentially circular opening allows the arrangement of the railing on the pin.

U.S. Pat. No. 2,681,834 A discloses a railing, which has a pivotable plate with a gate ("arcuate slot") on its end. The securing of the railing on a scaffolding pole is done by pivoting the plate.

From GB 1 242 224 A, a further multi-part railing with pivoting gates has become known.

EP 0 234 657 A2 discloses different railings. In particular, EP 0 234 657 A2 discloses one-piece railings with a gate into which a bow-shaped securing element of a scaffolding pole can be received.

From EP 1 589 162 A1, a railing fastening has become known which comprises a projection pointing downward in the assembled state of a scaffolding pole. The projection is arranged on a U-shaped stirrup. The railing has a hole with a recess for receiving the projection, wherein an attachment of the railing is effected by a rotation of the railing about the hole axis.

GB 901,351 A discloses a multi-part railing with a sliding fastening part.

From U.S. Pat. No. 3,323,271 A, it has become known to slide a railing onto a connector of two scaffolding poles and lock them with a locking device.

DE 1 559 069 A discloses the mounting of a retaining pole on a V-shaped wedge, wherein the retaining pole has a V-shaped gate for receiving the wedge.

From DE 196 33 092 A1 a scaffolding pole is known, from which a pin extends away vertically in the assembled state of the scaffolding pole. The pin has at least two upwardly directed projections which prevent a scaffolding pole that has been threaded onto the pin from being pulled off horizontally.

JP 2006 226 001 A discloses a railing that can be mounted in advance and having a hook-shaped pin for mounting a railing.

A scaffolding pole with a mounting pin has become known from EP 1 262 611 A2. A square plate for holding a railing is provided on the mounting pin.

JP 2004 76468 A provides a movable hook on a scaffolding pole to attach a railing to the scaffolding pole.

DE 10 2004 005 636 A1 teaches to provide an S-shaped hook on the scaffolding pole for the arrangement of a railing on the scaffolding pole.

U.S. Pat. No. 6,006,862 A has disclosed a railing arm attachment with a hook bent multiple times.

The generic DE 20 2008 001 019 U1 discloses a system scaffold with a railing that can be arranged on a semicircular receiving stirrup. Both the mounting and dismantling of the railing can be done without tools by a 180° rotation of the railing around its longitudinal axis. The railing is removable by a continuous rotational movement of the receiving bracket.

In the prior art, the attachment of a railing is accomplished, to state it briefly, via moving parts for locking the railing to a scaffolding pole. Alternatively, the locking is done by a gate of the railing on a pin of the scaffolding pole, which makes the unthreading of the railing more difficult either because of the gate guide or because of the bend in the pin.

SUMMARY OF THE INVENTION

The object of the present invention is, by contrast, to provide a cost-effective solution by which a railing from a lower scaffolding level is mountable or removable with simplified handling, large clearance width and at the same time high security against accidental disassembly.

This object is achieved according to the invention by a scaffolding element, a scaffold and a method.

The object of the invention is thus achieved by a scaffolding element with a scaffolding pole and a fastening element for attachment of a railing. The fastening element is immovably connected to the scaffolding pole and has a fastening element body. The fastening element body is designed to be intrinsically rigid or immovable. The fastening element body is connected at one end directly or indirectly to the scaffolding pole. The other end of the fastening element is a free end. The free end runs within ±25° parallel to the longitudinal axis of the scaffolding pole. A projection that is designed to project from the fastening element body out to the scaffolding pole prevents an unwanted dismantling of the railing during work on the scaffold without further reducing the clearance width of the scaffold.

Because of the free end of the fastening element body running essentially parallel to the scaffolding pole it is possible for the railing to slip out at the top in the assembled state of the scaffolding pole. Overall, this achieves a very easy handling of the railing with high security of the railing against unwanted removal and large clearance width.

The free end preferably runs within ±15° parallel, in particular within ±10° parallel, particularly preferably within ±5° parallel, to the longitudinal axis of the scaffolding pole.

The fastening element body is structurally especially simply configured and the scaffolding element can be especially economically produced as a result if the fastening element body is configured in the form of a bolt, in particular in the form of a forged part. In order to prevent the railing from snagging, the cross-section of the fastening element body is preferably formed free of edges. More preferably still, the fastening element body has a circular or oval cross-section.

Especially preferably, the fastening element body has an L-shaped design. As a result, the overall design of the scaffolding element with a large clearance width of the scaffold is significantly simplified. The longer, vertical portion of the L shape comprises the free end of the fastening element body. This section preferably transitions through a quarter-round section into the lower section of the L shape.

The lower section of the L shape of the fastening element body runs in the assembled state of the scaffolding element preferably horizontally ±20°, in particular horizontally ±10°, particularly preferably horizontally ±50°.

In the assembled state of the fastening element, the projection is preferably arranged or formed below the free end of the fastening element body on the fastening element body.

The manufacture of the scaffolding element is simplified and the function of the fastening element improved when the projection is in the form of a bead which extends radially around the fastening element body.

In order to further increase the clearance width of the scaffold and to reduce the risk of snagging during passage through the scaffold, the bead preferably does not extend past the fastening element body on the side facing away from the scaffolding pole of the fastening element. In a particularly preferred embodiment of the invention, the fastening element body has—except for the projection or bead—a constant cross-section.

The fastening element body can, in particular by stud welding, be directly welded to the scaffolding pole. Alternatively, the fastening element may have a fastening element plate which is connected on its first main side to the fastening element body and on the opposite main side is welded to the scaffolding pole, in particular by MAG welding (metal-active gas welding).

The object according to the invention is further achieved by a scaffold with a scaffolding element described above and a railing. The railing has at each of its two ends a first through-opening. The first through-openings are each configured in the form of a closed gate. At least one first through-opening can be configured in the form of a slot. Preferably, the two first through-openings are each configured in the form of a slot.

The first two through-openings can be formed identically. As a result, a worker does not have to pay attention to the orientation of the railing during assembly or he does not have to pay attention to which first end of the railing he inserts. Preferably, the through-openings are mounted eccentrically with respect to the longitudinal axis of the railing. As a result, the part of the fastening element body projecting away from the scaffolding pole can be made shorter, so that a larger clearance width is created.

The railing preferably has a second through-opening at each end. The second through-openings are each configured in the form of a closed gate.

At least one second through-opening may be configured in the form of a slot. Preferably, the two second through-openings are each configured in the form of a slot.

The second through-openings can be formed identically.

Particularly preferably, the second through-openings are formed identical to the first through-openings.

More preferably, the through-openings at both ends of the railing are perpendicular to the longitudinal axis of the railing and are equidistant from the outer edge of the railing. The railing can thereby be mounted both close to the scaffolding pole and independent of its orientation.

In a further preferred embodiment of the scaffold, the clear width of a first through-opening, in particular the clear width of a second through-opening, preferably the clear width of all through-openings, perpendicular to the longitudinal axis of the railing, corresponds with a clearance fit to the maximum cross-sectional width of the fastening element, in particular to the maximum cross-sectional width in the region of the projection. The railing in this case can be disassembled from the fastening element only when it is precisely aligned and removed from the fastening element.

The object of the invention is further achieved by a method for handling a scaffold with a railing having the following method steps:

A) for mounting the railing:

inserting the railing by moving one end of the railing to within ±25° parallel to the longitudinal axis of the scaffolding pole;

turning the railing 90°±10° about the longitudinal axis of the railing, or parallel to the longitudinal axis of the railing, into its secured position;

or

B) for dismantling the railing:

turning the railing 90°±10° about the longitudinal axis of the railing, or parallel to the longitudinal axis of the railing, out of its secured position;

subsequent removal of the railing by moving one end of the railing to within ±25° parallel to the longitudinal axis of the scaffolding pole.

The attachment of the railing is thus carried out by a lowering of the railing to a position essentially parallel to the scaffolding pole and then a quarter turn of the railing. The removal of the railing is accomplished vice-versa by a quarter turn of the railing and subsequent raising of the railing to a position essentially parallel to the scaffolding pole.

Before and/or after the method steps a) and b) or c) and d), an additional method step or additional method steps can be carried out. Preferably, however, the one-sided assembly or disassembly of the railing, respectively, on the scaffolding pole or from the scaffolding pole is limited to the above-described method steps a) and b) or c) and d).

The above-described handling of the railing preferably is carried out from a lower scaffolding level. In other words, the worker is preferably located at the n-th scaffolding level to install/uninstall the locking mechanism through the railing in the (n+1)th scaffolding level.

The above-described handling of the railing according to the method steps a) and b) is more preferably carried out initially at one end of the railing on a scaffolding pole, which is located in the upper scaffolding level, i.e. in the (n+1)th scaffolding level, and then at the opposite end of the railing on another scaffolding pole, which is located in the lower scaffolding level, i.e. in the nth scaffolding level, and is then mounted in the upper scaffolding level.

Prior to the above-described process steps c) and d), the disassembly of a scaffolding pole in the upper scaffolding level and movement of the scaffolding pole down into the lower scaffolding level are even more preferably carried out first. After the process steps c) and d) are carried out, the process steps c) and d) are preferably carried out again at the other end of the railing on a further scaffolding pole in the upper scaffolding level.

The method according to the invention thus enables both the prior mounting and the prior disassembly of the railing.

The methods described above are particularly preferably carried out with a scaffold.

BRIEF DESCRIPTION OF THE DRAWINGS

Further features and advantages of the invention will become apparent from the following detailed description of a plurality of exemplary embodiments of the invention, with reference to the figures of the drawings, which show essential features of the invention, and from the claims. The features shown in the drawings are depicted in such a way that the special features according to the invention can be made clearly visible. The various features can each be realized in variants of the invention individually or by any combination of a plurality of features.

Shown are.

DETAILED DESCRIPTION

Figure 1C:
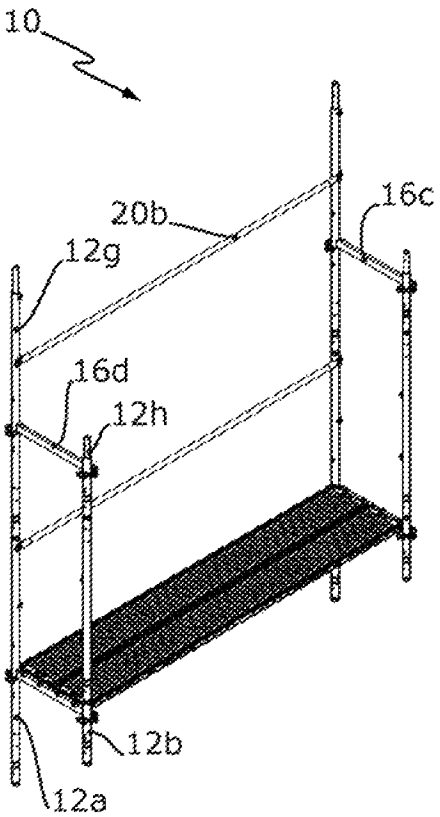
FIGS. 1*a*-1*c* Isometric views of the structure of a scaffold according to the invention.
Figure 1B:
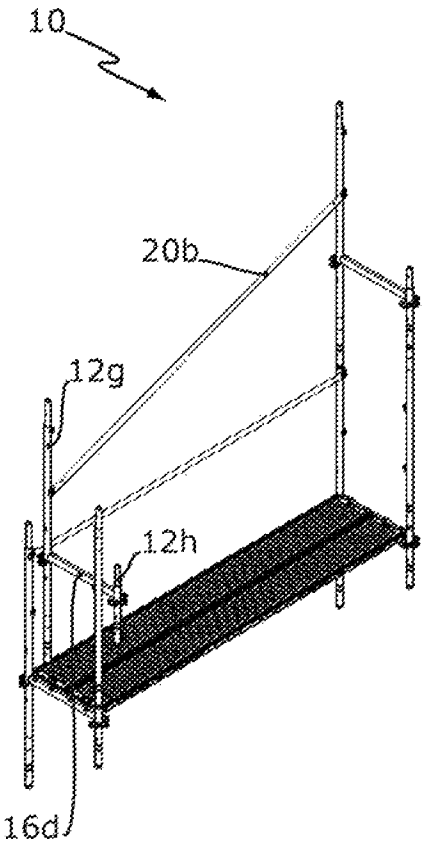
Figure 1A:
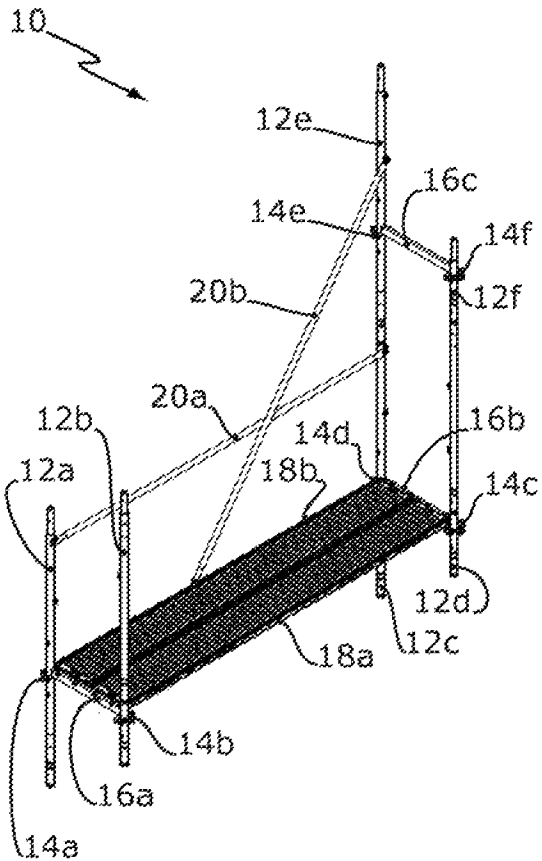

FIG. 1*a* shows a portion of the scaffold 10. The scaffold 10 has a plurality of vertical scaffolding poles 12*a*-12*f* in the mounted state. The scaffolding poles 12*a*-12*f* each have an essentially horizontal fastening plate 14*a*-14*f* The fastening plates 14*a*-14*f* are each in the form of a rosette. The fastening plates 14*a*-14*f* are used to arrange further in scaffolding elements that are not depicted in FIG. 1*a*.

Two scaffolding posts 12*a*-12*f* are connected by a cross-bar 16*a*-16*c*. Linings can be hooked into the cross-bars 16*a*-16*c*, wherein in FIG. 1*a*, a first lining 18*a* and a second lining 18*b* are arranged between the cross-bars 16*a* and 16*b*.

To prevent a worker from falling on the scaffold 10, railings 20*a*, 20*b* are provided. The railings 20*a*, 20*b* are pre-mountable, i.e. they are mountable before a worker steps onto the scaffolding level in which the railings 20*a*, 20*b* protect the worker from falling. The railing 20*a* is depicted in FIG. 1*a* in the fully assembled state in the lower scaffolding level, i.e. in the n-th scaffolding level, in which the worker is also located. By contrast, the railing 20*b* is already hooked on the scaffolding pole 12*e* that already belongs to the next higher, upper or (n+1)th scaffolding level from the lower scaffolding level out from one end.

FIG. 1*b* shows the further assembly of the railing 20*b*. The railing 20*b* is arranged at the other end on a scaffolding pole 12*g* of the scaffold 10, which is connected to a scaffolding pole 12*h* via a cross-bar 16*d*.

FIG. 1*c* shows the scaffold 10 in a further mounted state. Accordingly, the scaffolding pole 12*g* is inserted on the scaffolding pole 12*a* and the scaffolding pole 12*h* is inserted on the scaffolding pole 12*b*. The railing 20*b* was pivoted upward during assembly of the scaffolding poles 12*g* and 12*h* and is now already mounted on the scaffold 10, before further linings (not depicted) are mounted between the cross-bars 16*c*, 16*d*. The scaffold 10 according to the invention can thus be mounted particularly securely. It is also possible here to remove the railing 20*b* on both sides of the scaffolding poles 12*e* and 12*g* if, for example, something must be brought laterally onto the scaffold 10 with a crane. The disassembly of the railing 20*b* is done in the reverse order according to FIGS. 1*c*-1*a*. The railing 20*b* can thus be both mounted and dismantled in advance.

The railings 20*a* shown in FIGS. 1*a*-1*c* are mounted at waist height of a worker; the railing 20*b* is mounted at knee height of a worker. Together with the railing 20*a* at waist height, another railing 20*b* (not shown) in the same scaffolding level at knee height can be both mounted and dismantled in advance. Furthermore, together with the railing 20*b* at knee height another railing (not shown) in the same scaffolding level at waist height can be both mounted and dismantled in advance.

Figure 2:
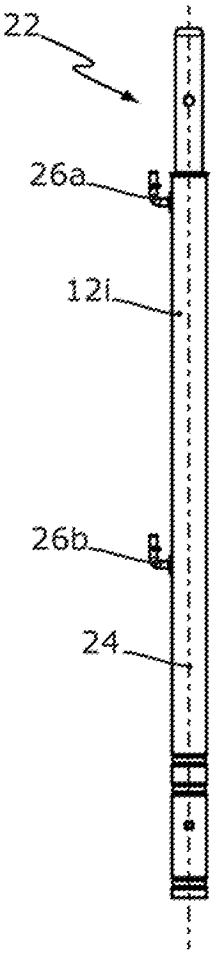
FIG. 2 a side view of a scaffolding pole.

FIG. 2 shows a scaffolding element 22 with a scaffolding pole 12*i* without a fastening plate and without a cross-bar. The scaffolding pole 12*i* has a longitudinal axis 24. Fastening elements 26*a*, 26*b* are arranged parallel to the longitudinal axis 24 and spaced from each other on the scaffolding pole 12*i*, in particular welded.

Figure 3A:
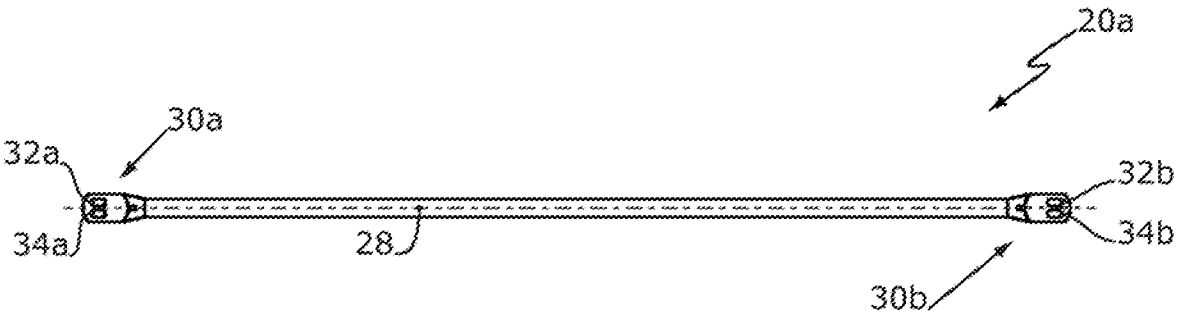
FIG. 3*a* a side view of a scaffolding pole.

FIG. 3*a* shows the railing 20*a* (see FIG. 1*a*) for the arrangement on the fastening element 26*a* or 26*b* (see FIG. 2). The railing 20*a* has a longitudinal axis 28. The railing 20*a* is formed mirror-symmetrically with respect to a plane of symmetry extending perpendicular to the drawing plane and intersecting the longitudinal axis 28. The railing 20*a* is formed mirror-symmetrically with respect to a plane of symmetry extending perpendicular to the drawing plane and extending perpendicular to the longitudinal axis 28. In particular, the two ends 30*a*, 30*b* of the railing 20*a* are formed as mirror images of each other. A worker can therefore mount the railing 20*a* largely independent of its orientation. From FIG. 3*a* it can be seen that the railing 20*a* has first through-openings 32*a*, 32*b* and second through-openings 34*a*, 34*b*. A fastening element 26*a*, 26*b* (see FIG. 2) can be inserted into any one of the through-openings 32*a*, 32*b*, 34*a*, 34*b*.

Figure 3B:
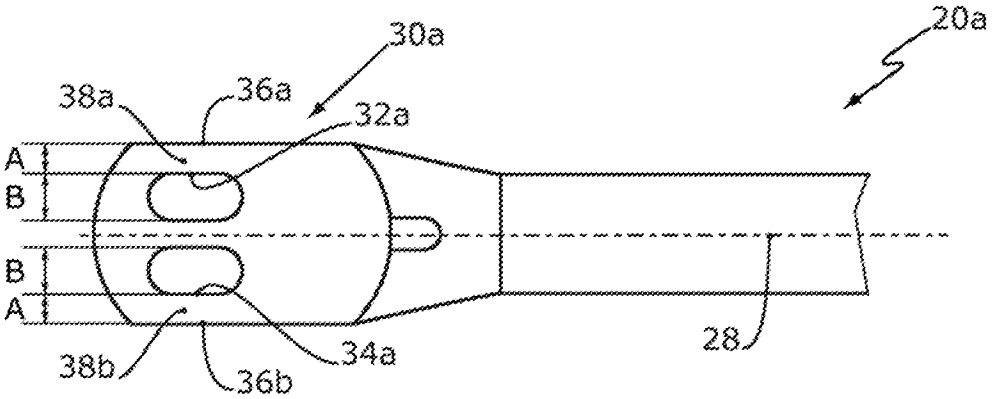
FIG. 3*b* an enlarged partial view of FIG. 3*a;*

FIG. 3*b* shows an enlarged partial view of the railing 20*a* in the region of the end 30*a*. From FIG. 3*b* it can be seen that the through-openings 32*a*, 34*a* are each configured in the form of a slot. The distance A of the through-openings 32*a*, 34*a* to the respective outer edges 36*a*, 36*b* of the end 30*a* is equal. Preferably, the distance A is smaller than the width B of the through-openings 32*a*, 34*a* perpendicular to the longitudinal axis 28. By virtue of the relatively narrow webs 38*a*, 38*b* with the width A, the railing 20*a* can be mounted relatively closely to the scaffolding pole 12*i* (see FIG. 2). This will be apparent from FIG. 4*b* below.

Figure 4B:
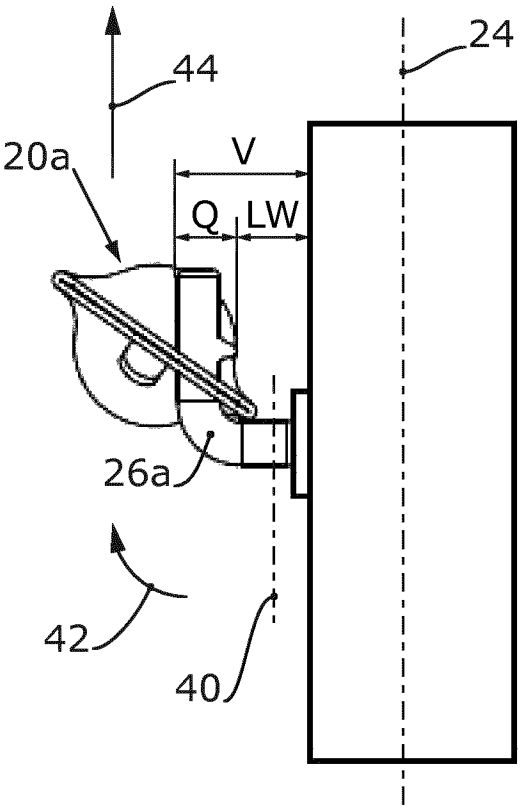
FIG. 4*b* a side view of the scaffold part of FIG. 3*a;*
Figure 4A:
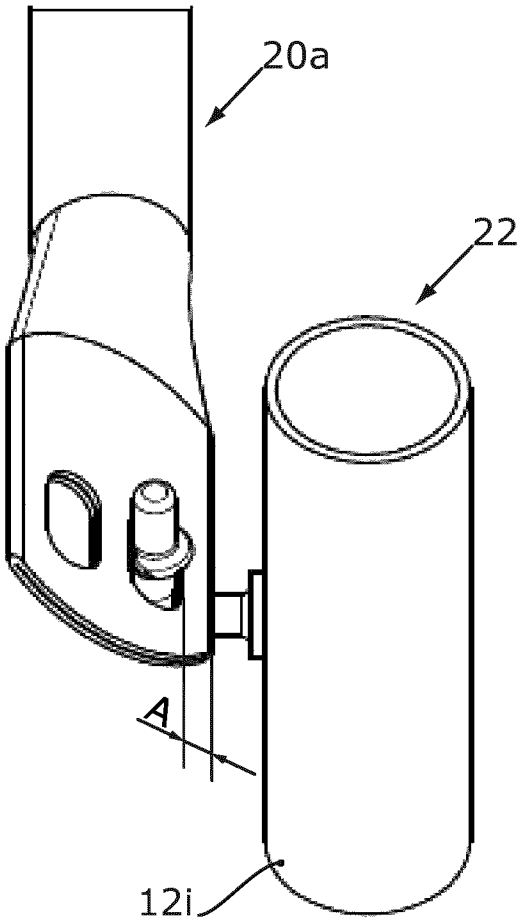
FIG. 4*a* an isometric partial view of the scaffolding pole of FIG. 2 with mounted railing according to FIGS. 3*a* and 3*b* with lift-off securing.

FIG. 4*a* and FIG. 4*b* show the scaffolding element 22 with the railing 20*a*. The railing is respectively shown in a state in which it was raised by mistake.

It can be seen from FIG. 4*a* that the first end 30*a*—as well as the second end 30*b* (see FIG. 3*a*)—is done by flattening the railing tube.

From FIG. 4*b* it can be seen that the clear width LW between the scaffolding pole 12*i* and a projection 54 (see FIG. 5*b*), in particular a bead 56 (see FIG. 5*b*), must only be slightly wider than the width A of the web 38*a* or 38*b* (see FIG. 3*b*). As a result, the clearance width available for a worker between the fastening element 26*a* and the opposite side, be it a building or another railing or another fastening element 26*d*, is hardly reduced. The clearance width is only reduced by the overhang V of the fastening element 26*a*. The overhang V is comprised of the clear width LW and the cross-sectional width Q. In addition, the shape of the fastening element 26*a* minimizes the danger of a worker located on the scaffold 10 (see FIGS. 1*a*-1*c*) getting caught or injured on the fastening element 26*a*-*c*.

A dotted line 40 indicates the locking position of the railing 20*a*. As shown by an arrow 42, the railing 20*a* can be rotated by 90° and then be removed in the direction of an arrow 44 from the fastening element 26*a*. The removal direction according to the arrow 44 extends parallel to the longitudinal axis 58 of the free end 52 of the fastening element 26*a*.

From an overview of FIGS. 3*a*, 3*b* and 4*b*, it can also be seen that the width B of the through-openings 32*a*, 32*b*, 34*a*, 34*b* corresponds to the maximum cross-sectional width Q of the fastening element 26*a* with a clearance fit.

Figure 5B:
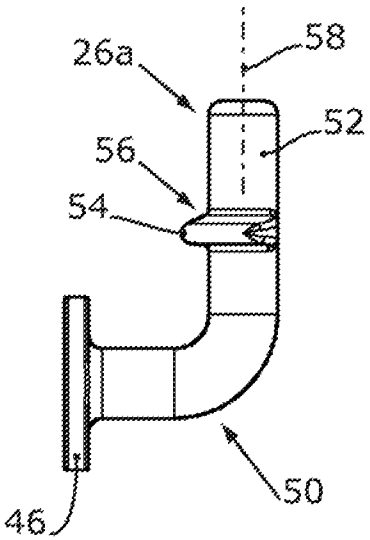
FIG. 5*b* a side view of the fastening element of FIG. 5*a*.
Figure 5A:
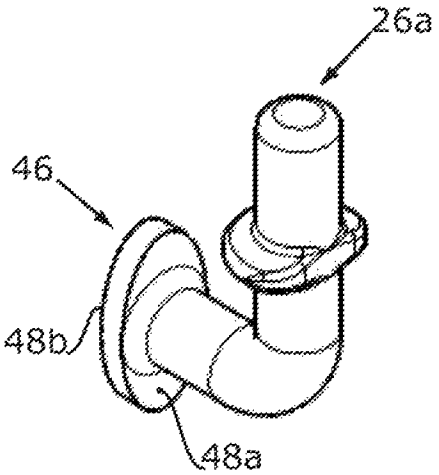
FIG. 5*a* an isometric view of a fastening element according to FIGS. 2, 4*a* and 4*b;*

FIG. 5*a* shows the fastening element 26*a* and a fastening element plate 46. The fastening element plate 46 serves for the easy welding of the fastening element 26*a* to the scaffolding pole 12*i* (see FIG. 4*a*) or to a scaffolding pole 12*a*-12*h* according to FIGS. 1*a*-1*c*. The fastening element plate 46 is thus integrally formed or welded to a side 48*a* or first main side of the fastening element plate 46 on the fastening element 26*a*. On the opposite side 48*b* or second main side of the fastening element plate 46, the fastening element plate 46 is joined to the scaffolding pole 12*i*, in particular welded to it.

FIG. 5*b* shows a side view of the fastening element 26*a* with the fastening element plate 46. From FIG. 5*b* it can be seen that the fastening element 26*a* has a fastening element body 50. The fastening element body 50 is L-shaped. The fastening element body 50 has the shape of a pin or bolt with constant cross-section. A free end 52 of the fastening element body 50 serves for receiving a through-opening 32*a*, 32*b*, 34*a*, 34*b* (see FIG. 3*a*).

A projection 54 on the fastening element body 50 points toward the scaffolding pole 12*i* (see FIG. 4*a*) to prevent an unintentional detachment of the railing 20*a* (see FIG. 4*a*). The projection 54 is configured in the form of a part of a bead 56. As can be seen from an overview of FIGS. 5*a* and 5*b*, the bead 56 extends radially around the fastening element body 50, wherein the bead 56 does not protrude beyond the fastening element body 50 on the side pointing away from the scaffolding 12*i* (see FIG. 4*a*).

The free end 52 of the fastening element body 20 has a longitudinal axis 58 which runs essentially parallel to the longitudinal axis 24 (see FIG. 4*b*) of the scaffolding pole 12*i* (see FIG. 4*a*).

An overview of FIGS. 4*a*, 4*b*, 5*a*, 5*b* shows that the railing 20*a* may indeed rotate about its longitudinal axis 28 and move along the fastening element body 50 when inadvertently lifted, but on contact with the bead 56 rotates beyond 90° until the inner edge of the corresponding through-opening 32*a*, 32*b*, 34*a*, 34*b* abuts the free end of the fastening element 26*a*. In this position, an unintentional further lifting of the railing 20*a* and thus an inadvertent release is not possible. The railing 20*a* is thus securely fastened to the scaffolding pole 12*i*.

Figure 6:
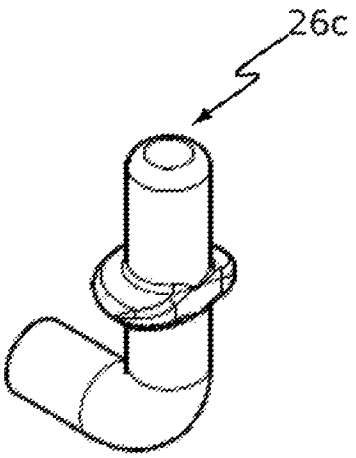
FIG. 6 an isometric view of another fastening element.

FIG. 6 shows another exemplary embodiment of a fastening element 26*c*. The fastening element 26*c* corresponds to the fastening elements 26*a*, 26*b* (see FIG. 2), wherein no fastening element plate 46 (see FIGS. 5*a* and 5*b*) is provided for mounting the fastening element 26*c*. The fastening element 26*c* may be arranged by stud welding on a scaffolding pole 12*a* to 12*i* (see FIGS. 1*a*-1*c* and 2); the end pointing toward the scaffolding pole 12*a* to 12*i* has a suitable geometry (not depicted) for this depending on the selected method.

In the context of viewing all the figures of the drawings together, the invention relates comprehensively to a scaffolding element 22 having a scaffolding pole 12*a*-12*i*, wherein at least one fastening element 26*a*-26*c* is arranged or formed on the scaffolding pole 12*a*-12*i*. The fastening element 26*a*-26*c* preferably has a fastening element body 50. The fastening element body 50 may have an L-shaped design. Preferably, the free end 52 of the fastening element body 50 in the mounted state of the scaffolding element 22 points straight up. On the fastening element body 50, a projection 54 is arranged or formed below the free end 52 in particular in a section parallel to the longitudinal axis 24 of the scaffolding pole 12*a*-12*i*. The projection 54 may be part of a U-shaped bead 56.

The invention claimed is:

1. A scaffolding element having a scaffolding pole and a longitudinally extending fastening element for attaching a railing to the scaffolding pole, wherein the fastening element is rigidly connected to the scaffolding pole and the fastening element has an L-shaped fastening element body, wherein a longitudinal axis of a free end of the fastening element body runs parallel ±25° to a longitudinal axis of the scaffolding pole, and the fastening element has a projection formed by a bead on the fastening element body projecting toward the scaffolding pole, wherein the bead extends at least partially radially around the fastening element body, wherein the bead does not project beyond the fastening element body on a side of the fastening element facing away from the scaffolding pole, wherein the free end of the fastening element body points straight up in a mounted state of the scaffolding element, wherein, on the fastening element body, the projection is arranged or formed below the free end in a section parallel to the longitudinal axis of the scaffolding pole in the mounted state of the scaffolding element.

2. The scaffolding element according to claim 1, wherein the fastening element body has a uniform cross-section.

3. The scaffolding element according to claim 1, wherein the fastening element body is welded directly to the scaffolding pole.

4. The scaffolding element according to claim 1, wherein the scaffolding element has a fastening element plate which is connected on one side to the fastening element body and is welded on an opposite side to the scaffolding pole.

5. The scaffolding element according to claim 1, wherein a longer, vertical portion of the L-shape comprising the free end of the fastening element body transitions through a quarter-round section into a lower section of the L-shape.

6. The scaffolding element according to claim 1, wherein the bead is U-shaped.

7. A scaffold having the scaffolding element according to claim 1 and the railing, wherein the railing includes two ends, each end of the two ends of the railing includes a first through-opening enclosed all around defining a slot for receiving the fastening element body.

8. The scaffold according to claim 7, in which the railing has a second through-opening enclosed all around defining a slot for receiving the fastening element body.

9. The scaffold according to claim 8, in which a width of the first and second through-openings at the two ends of the railing are each spaced equidistant from an outer edge of the railing, wherein the width is perpendicular to the longitudinal axis of the railing.

10. The scaffold according to claim 7, wherein a clear width of the first through-opening corresponds to a maximum cross-sectional width of the fastening element with a clearance fit, wherein the clear width is perpendicular to the longitudinal axis of the railing.

11. A scaffolding element, comprising:

a scaffolding pole defining a longitudinal axis; and a longitudinally extending fastening element for attaching a railing to the scaffolding pole, the fastening element being rigidly connected to the scaffolding pole, the fastening element having an L-shaped fastening element body, wherein a longitudinal axis of a free end of the fastening element body runs parallel ±25° to the longitudinal axis of the scaffolding pole, the fastening element having a projection formed by a bead on the fastening element body projecting toward the scaffolding pole, wherein the bead extends at least partially radially around the fastening element body, wherein the bead does not project beyond the fastening element body on a side of the fastening element facing away from the scaffolding pole, wherein the free end of the fastening element body points straight up in a mounted state of the scaffolding element, wherein, on the fastening element body, the projection is arranged or formed below the free end in a section parallel to the longitudinal axis of the scaffolding pole in the mounted state of the scaffolding element.

12. The scaffolding element according to claim 11, wherein the bead is U-shaped.

* * * * *